US008220634B2

(12) United States Patent
Mowery

(10) Patent No.: US 8,220,634 B2
(45) Date of Patent: Jul. 17, 2012

(54) DISPENSING CONTAINER

(75) Inventor: Jeremy D. Mowery, Raleigh, NC (US)

(73) Assignee: MeadWestvaco Corporation, Richmond, VA (US)

( * ) Notice: Subject to any disclaimer, the term of this patent is extended or adjusted under 35 U.S.C. 154(b) by 249 days.

(21) Appl. No.: 12/601,166

(22) PCT Filed: May 22, 2008

(86) PCT No.: PCT/US2008/064522

§ 371 (c)(1),
(2), (4) Date: Nov. 20, 2009

(87) PCT Pub. No.: WO2008/147880

PCT Pub. Date: Dec. 4, 2008

(65) Prior Publication Data

US 2010/0193395 A1 Aug. 5, 2010

Related U.S. Application Data

(60) Provisional application No. 60/939,543, filed on May 22, 2007.

(51) Int. Cl.
*B65D 85/42* (2006.01)

(52) U.S. Cl. ..... 206/528; 206/531

(58) Field of Classification Search ..... 206/531, 206/532, 528, 538, 828, 469, 232, 472, 473, 206/475; 53/484, 491
See application file for complete search history.

(56) References Cited

U.S. PATENT DOCUMENTS

| | | | | |
|---|---|---|---|---|
| 1,548,237 | A | 8/1925 | Ackermann | |
| 1,871,426 | A * | 8/1932 | Schmitt | 206/474 |
| 3,324,998 | A | 6/1967 | Farquhar | |
| RE35,445 | E * | 2/1997 | Pora | 206/532 |
| 5,954,202 | A * | 9/1999 | Mellon | 206/462 |
| 5,988,429 | A * | 11/1999 | Coe | 221/25 |
| 6,024,222 | A * | 2/2000 | Friberg et al. | 206/531 |
| 6,978,562 | B2 * | 12/2005 | Frenkel | 40/124.06 |
| 2005/0274643 | A1 * | 12/2005 | Arnold | 206/531 |
| 2010/0038277 | A1 * | 2/2010 | Rapp et al. | 206/531 |

FOREIGN PATENT DOCUMENTS

| | | | |
|---|---|---|---|
| DE | 102006021980 | A1 * | 5/2007 |
| WO | WO 2007057286 | A1 * | 5/2007 |

* cited by examiner

*Primary Examiner* — J. Gregory Pickett
*Assistant Examiner* — Andrew Perreault
(74) *Attorney, Agent, or Firm* — MWV Intellectual Property Group

(57) ABSTRACT

A dispensing system (300) includes a packaging structure (200) and a blank (100) that is constructed to enclose the packaging structure (200). The dispensing system (300) includes a top panel (110) and a bottom panel (112) that define a tubular structure (310) and includes side flaps (120*a*, 120*b*) that are configured to extend into the tubular structure (310). The side flaps (120*a*, 120*b*) close the open sides of the tubular structure (310).

13 Claims, 4 Drawing Sheets

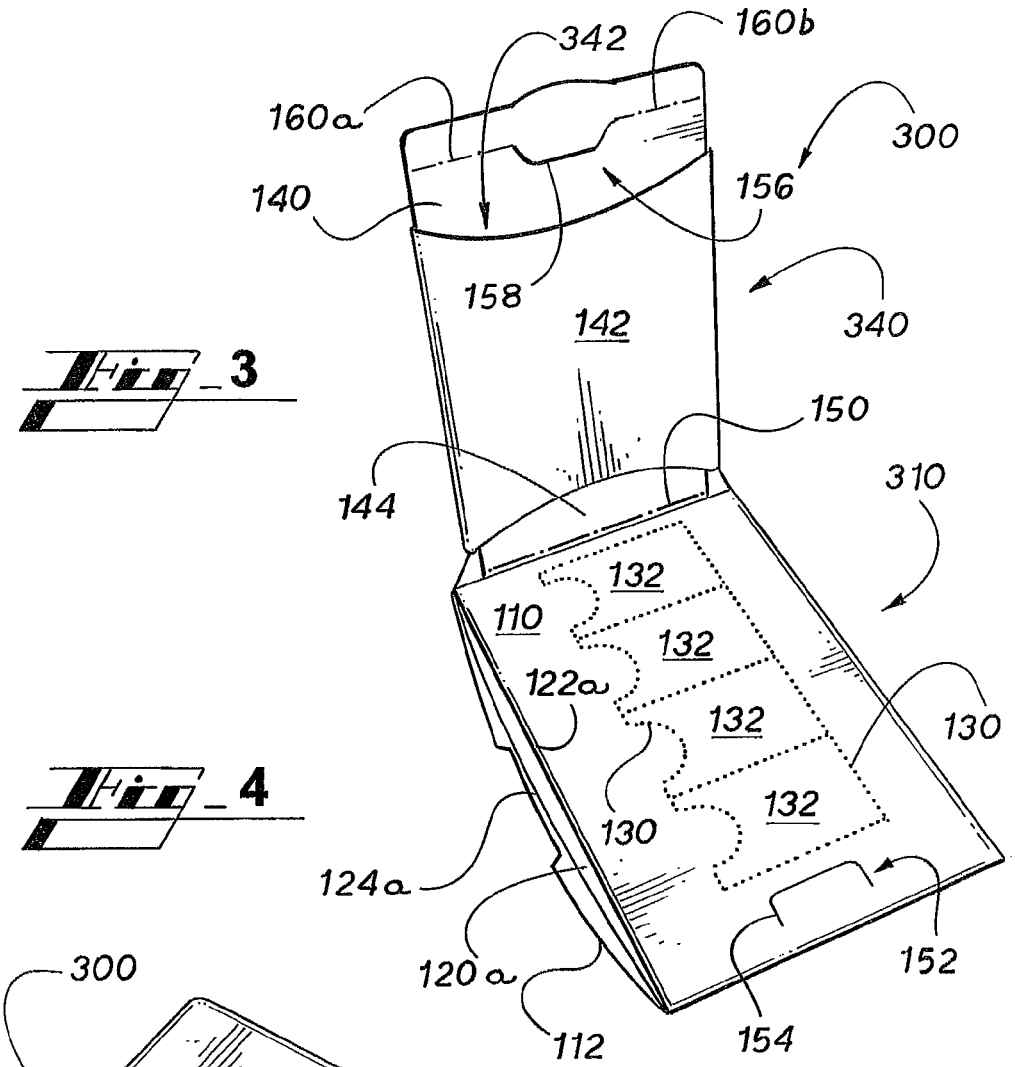
Fig. 3
Fig. 4
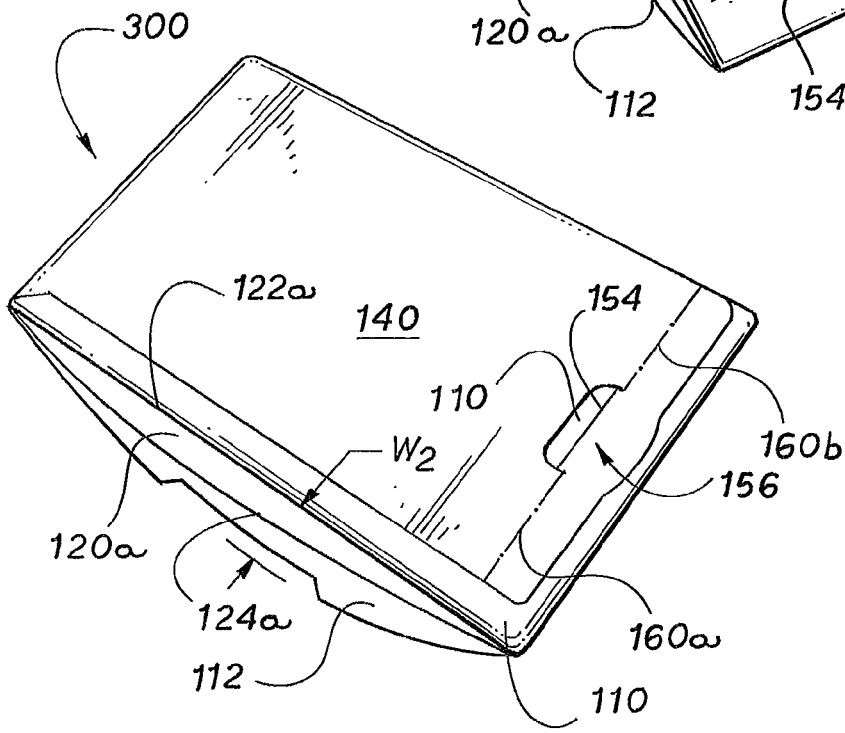

DISPENSING CONTAINER

CROSS REFERENCE TO RELATED APPLICATIONS

This application claims priority to U.S. Provisional Application No. 60/939,543 filed May 22, 2007, the entirety of which is incorporated herein by reference.

TECHNICAL FIELD

This disclosure relates generally to containers and, more specifically, to containers for blister packs.

BACKGROUND

Articles such as pharmaceuticals and tobacco plugs are commonly dispensed from blister packs or as loose-fill. The packaging and dispensing of such articles requires continuous improvement to address issues such as child resistance, cost, and ergonomics in a new and better way.

For example, in accordance with certain dispensing containers, articles are packaged in blister packs and secondary packaging. The secondary packaging leaves parts of the blister pack exposed such that the child resistance of the dispensing container may be reduced. Other dispensing containers have a high degree of child resistance but are expensive to make, complicated to manufacture, and complicated to use.

SUMMARY

The various embodiments of the present disclosure overcome the shortcomings of the prior art by providing a container that is inexpensive, simple to construct, and can be used to package and dispense items from a blister pack or tray. The container is inexpensive and easily constructed as few folding and securing steps are required to construct the container. The container can house a blister pack to prevent tampering with the blister pack and to controllably dispense articles from the blister pack.

An exemplary container includes a tubular structure with opposed open sides and a side flap hingedly connected to an edge of the tubular structure at each open side. The side flaps extend inwardly into the tubular structure and a distal edge of each side flap substantially abuts the inside surface of the tubular structure so as to substantially close each open side. The extending dimension of each of the side flaps, measured between a hinged connection and a distal edge, is greater than the open side dimension of each of the open sides of the tubular structure to prevent the side flaps from folding outward. Items in the container, such as loose fill items or items packaged in a blister pack, can prevent the side flap from folding further inward. Thus, a side flap closes the open side of the tubular structure without having the distal edge of the side flap secured in place.

The tubular structure can be defined by a top panel and a bottom panel, the opposed end edges of which are proximate or are hingedly connected to one another. The tubular structure can be shaped such that the top panel is substantially flat and the bottom panel is substantially curved. Here, the bottom panel is longer than the top panel. With such a tubular structure, the side flaps can be hingedly connected to opposed side edges of the top panel and the distal edges of the side flaps can be curved so as to correspond to the curvature of the bottom panel.

The container includes an arrangement of severance lines that define detachable tabs. The tabs can be removed to access the interior of container. In addition to or in place of the detachable tabs, the container can include an aperture, an alternative arrangement of severance lines, a slit, a flap, combinations thereof, and the like. The detachable tabs can be formed in the top panel or the bottom panel. To disguise the location of the detachable tabs, close openings provided by removing the detachable tabs, and protect the detachable tabs, the container includes a cover that is hingedly connected to the tubular structure and that can be releasably secured, for example, to the tubular structure by locking tabs. The locking tabs can be formed by severance lines and can be configured in different ways to be able to releasably engage one another. A locking tab can also releasably engage with an aperture, a slot, and edge, combinations thereof, and the like.

The cover can include cover panels that are hingedly connected to the top panel and bottom panel. The cover panels may be secured together to provide the cover flap. Alternatively, there can be a sliding connection between cover panels that form the cover. For example, one of the cover panels can include a sleeve and the other of the cover panels can include an insert that can slide within the sleeve.

The foregoing has broadly outlined some of the aspects and features of the present disclosure, which should be construed to be merely illustrative of various potential applications of the disclosure. Other beneficial results can be obtained by applying the disclosed information in a different manner or by combining various aspects of the disclosed embodiments. Accordingly, other aspects and a more comprehensive understanding of the disclosure may be obtained by referring to the detailed description of the exemplary embodiments taken in conjunction with the accompanying drawings, in addition to the scope defined by the claims.

BRIEF DESCRIPTION OF THE DRAWINGS

FIGS. 3 and 4 are perspective views of a container formed from the blank and blister pack of FIG. 1, a cover being illustrated in open and closed positions.

DETAILED DESCRIPTION

Figure 1:
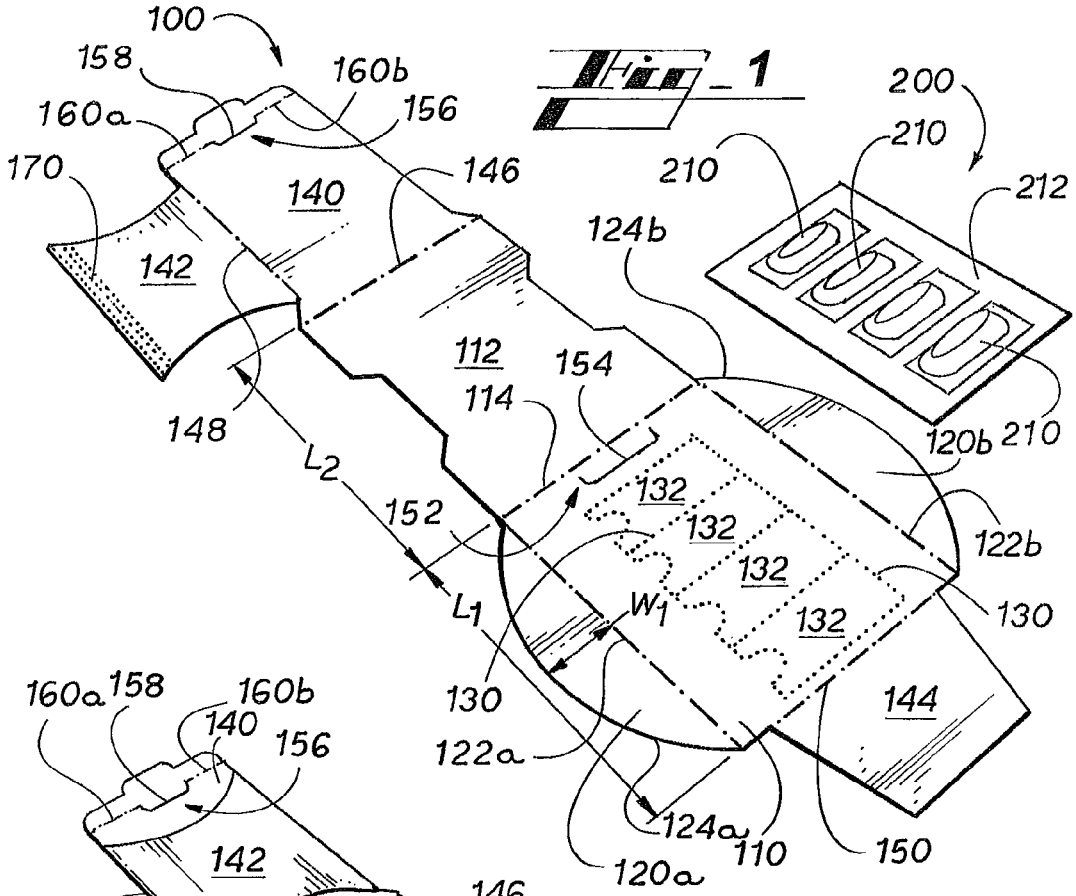
FIG. 1 is a perspective view of a blank and a blister pack, according to a first exemplary embodiment of the present disclosure.

As required, detailed embodiments of the present disclosure are disclosed herein. It must be understood that the disclosed embodiments are merely exemplary of the disclosure that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Referring now to the drawings, wherein like numerals indicate like elements throughout the several views, the drawings illustrate certain of the various aspects of exemplary embodiments of a container. In the embodiments detailed herein, for the non-limiting purpose of illustrating the various features of the disclosure, the container is configured for enclosing, carrying, and dispensing articles such as pharmaceuticals and tobacco plugs.

Referring to a first exemplary embodiment illustrated in FIGS. 1-4, a container 300 is formed from a blank 100 and a blister pack 200. The blank 100 is configured with respect to the blister pack 200 such that the container 300 is adapted to dispense articles from the blister pack 200. It is envisaged that the blank 100 can be configured with respect to other blister packs or for loose-fill articles.

Turning to FIG. 1, the blank 100 is first described. The blank 100 is illustrated as a single sheet of suitable substrate. As used herein, the term "suitable substrate" includes all manner of foldable sheet material such as paperboard, corrugated board, cardboard, plastic, combinations thereof, and the like. In the illustrated embodiments, the blank 100 is unitary although it should be recognized that two or more blanks may be employed to form the container 300.

As used herein, the term "fold line" includes all manner of lines that define hinge features of the blank, facilitate folding portions of the blank with respect to one another, or otherwise indicate optimal panel folding locations for the blank. A fold line is typically a scored line, an embossed line, or a debossed line.

As used herein, the term "severance line" includes all manner of lines that facilitate separating portions of the substrate from one another or that indicate optimal separation locations. Severance lines may be frangible or otherwise weakened lines, cut lines, or slits.

It should be understood that severance lines and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can have different degrees of weakness in order to define a fold line and/or a severance line. The line of perforations can be designed to facilitate folding and resist breaking, to facilitate folding and facilitate breaking with more effort, or to facilitate breaking with little effort.

The blank 100 includes primary panels that define the walls of a tubular structure 310 of the container 300. The primary panels include a top panel 110 and a bottom panel 112 that are hingedly connected to one another along a fold line 114. The bottom panel 112 has a length L2 that is greater than the length L1 of the top panel 110. It should be understood that a tubular structure can be formed from any number of panels.

Side flaps 120*a*, 120*b* define side walls of the erected container 300. Proximal edges of the side flaps 120*a*, 120*b* are hingedly connected to opposite side edges the top panel 110 along fold lines 122*a*, 122*b* and distal edges 124*a*, 124*b* of the side flaps 120*a*, 120*b* are curved. The curvature of each of the distal edges 124*a*, 124*b* corresponds to the curvature of the bottom panel 112 of the erected container 300, as described in further detail below. A extending dimension W1 of each of the side flaps 120*a*, 120*b* corresponds to a open end dimension W2 of each of the open sides of the tubular structure, as described in further detail below.

The top panel 110 includes severance lines 130 that define detachable tabs 132. The detachable tabs 132 are arranged with respect to the illustrated blister pack 200. The detachable tabs 132 can have any size or shape so as to provide a suitable opening for dispensing articles and the illustrated versions are provided as a non-limiting example. In place of or in addition to the detachable tabs 132, the top panel 110 can include apertures, alternative arrangements of severance lines, flaps, slots, combinations thereof, and the like. Also, the detachable tabs 132 can additionally or alternatively be formed in the bottom panel 112.

The container 300 includes a cover 340 that is arranged to selectively cover the detachable tabs 132. The cover 340 is formed from a cover panel 140, a sleeve flap 142, and an insert flap 144. The cover panel 140 is hingedly connected to the bottom panel 112 along a fold line 146, the sleeve flap 142 is hingedly connected to the cover panel 140 along a fold line 148, and the insert flap 144 is hingedly connected to the top panel 110 along a fold line 150. As described in further detail below, the cover panel 140 and the sleeve flap 142 combine to form a sleeve 342 in which the insert flap 144 is slidably inserted.

The container 300 further includes a first locking tab 152 defined by a severance line 154 formed in top panel 110 and second locking tab 156 defined by severance line 158 in cover panel 140. The first locking tab 152 can cooperate to releasably secure the cover 340 to the top panel 110 so as to hide and protect the detachable tabs 132. Fold lines 160*a*, 160*b* on each side of the severance line 158 allow the second locking tab 156 to rotate such that the second locking tab 156 can be inserted into a receiving slot defined by the first locking tab 152, as described in further detail below. An aperture, an opening, a slot, an edge, and the like can be used in place of the first locking tab 152.

The illustrated primary packaging structure is a blister pack 200 including blisters 210 and a substantially planar flange 212. The blisters 210 may be formed in a substantially planar piece of substrate material that provides the flange 212. The flange 212 and blisters 210 provides a tray for storing items. A backing (not shown), such as a foil or paperboard backing, can be attached to the planar flange 212 to enclose articles in the blisters 210. In certain embodiments, the top panel 110 provides the backing as a tray is secured to the top panel 110. In alternative embodiments, other packaging structures are incorporated such as bags, bladders, cups, trays, combinations thereof, and the like.

Constructing the container 300 from the blank 100 and the blister pack 200 may be accomplished with the operations as described herein. The operations can be performed by automatic erecting machinery and/or manually. The method of performing the constructing process is not limited to the exemplary method described herein. Particularly, the order of the steps can be altered according to manufacturing requirements and steps may be added or omitted. The components of the container 300 can be secured to another with any of tape, staples, interlocking folds, VELCRO®, glue or other adhesives, combinations thereof, and the like.

Figure 2:
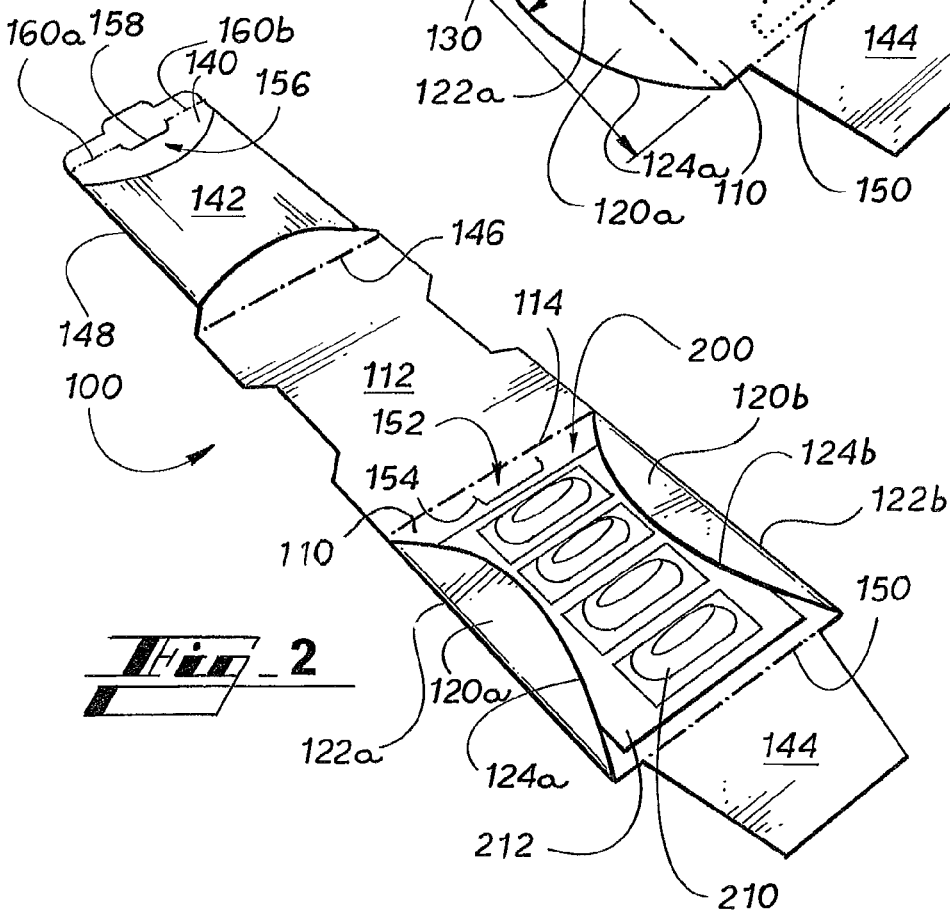
FIG. 2 is a perspective view of a partially formed container that combines the blank and blister pack of FIG. 1.

Referring to FIGS. 1 and 2, the blister pack 200 is combined with the blank 100 such that the flange 212 is in contact with the inside surface of the top panel 110 and such that each blister 210 aligns with the respective detachable tab 132. The blister pack may be secured to the blank 100 or may be set on the blank 100. The sleeve 342 is formed as the sleeve flap 142 is folded and secured to the cover panel 140. For example, the sleeve flap 142 can be secured to the cover panel 140 with a strip of adhesive 170. The side flaps 120*a*, 120*b* are folded inwardly along the fold lines 122*a*, 122*b* toward the blister pack 200 and the inside surface of the top panel 110. As such, the side flaps 120*a*, 120*b* are at an acute angle with the top panel 110.

Referring to FIGS. 2 and 3, the blank 100 is folded along the fold line 114 to enclose the blister pack 200 between the top panel 110, the bottom panel 112, and the side flaps 120*a*, 120*b*. As the blank 100 is folded, the bottom panel 112 curves around the blister pack 200 and comes into contact with the distal edges 124*a*, 124*b* of the side flaps 120*a*, 120*b*. As such, the bottom panel 112 maintains the side flaps 120*a*, 120*b* in the inwardly folded condition. The insert flap 144 slides into the sleeve 342 to form the cover 340 and to retain the bottom wall in the folded condition where the fold lines 146, 150 are proximate one another.

Referring to FIGS. 3 and 4, the container 300 is fully constructed and the cover can be releasably secured to the top panel 110 as the second locking tab 156 is pressed against the first locking tab 152 and into the receiving slot formed by the depressed first locking tab 152. As the extending dimension W1 of the side flaps 120*a*, 120*b* is greater than the open end dimension W2 of the open sides of the tubular structure 310, the distal edges 124*a*, 124*b* of the side flaps 120*a*, 120*b* are inwardly offset from the side edges of the bottom panel 112. The extending dimension W1 can be measured between the fold line 122*a* and the distal edge 124*a*. The open end dimension W2 can be measured between the top panel 110 and the bottom panel 112 when the tubular structure 310 is erected.

To access articles in the blister pack 200, the cover 340 is opened, one of the detachable tabs 132 is removed by breaking the associated severance lines 130, and any additional backing of the blister pack 200 is broken or removed. Thereafter, one or more articles can be removed from one of the blisters 210 and the cover 340 can be closed and releasably secured to the top panel 110 until another article is to be dispensed.

The side flaps 120*a*, 120*b* restrict access to the blister pack 200. The blister pack 200 obstructs the side flaps 120*a*, 120 from being folded inwardly to where the blister pack 200 could be accessed. In addition, the bottom panel 112 obstructs the side flaps 120*a*, 120*b* from being folded outwardly to access the blister pack 200.

Figure 5:
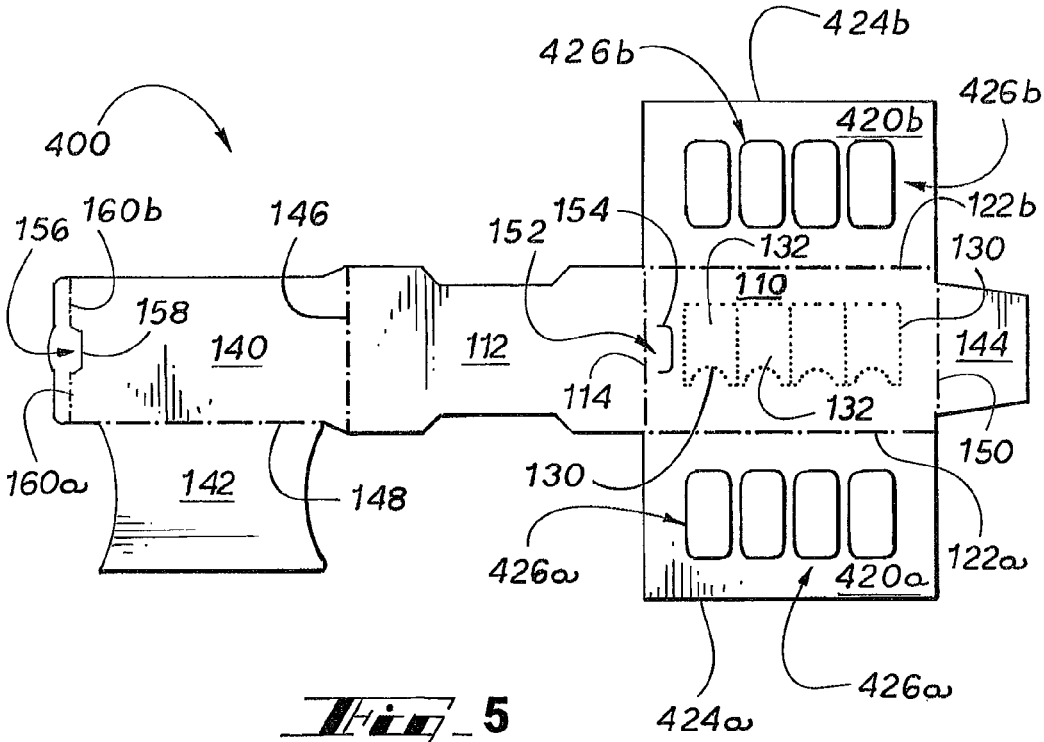
FIG. 5 is a plan view of a blank, according to a second exemplary embodiment of the present disclosure.

Referring to FIG. 5, an alternative blank 400 is illustrated includes elements of the blank 100 and side flaps 420*a*, 420*b* that include apertures 426*a*, 426*b* for receiving the blisters 210. A container formed from the blank 400 secures a blister pack 200 as the side flaps 420*a*, 420*b* secure the flange 212 between the top panel 110 and overlapping side flaps 420*a*, 420*b* as each blister 210 is received in apertures 426*a*, 426*b*. Here, the distal edges 424*a*, 424*b* are disposed proximate a fold line 122*b*, 122*a*, respectively. Alternatively, this embodiment provides increased child resistance for loose fill articles as the side flaps 420*a*, 420*b* may be secured to the top panel or each other.

Figure 6:
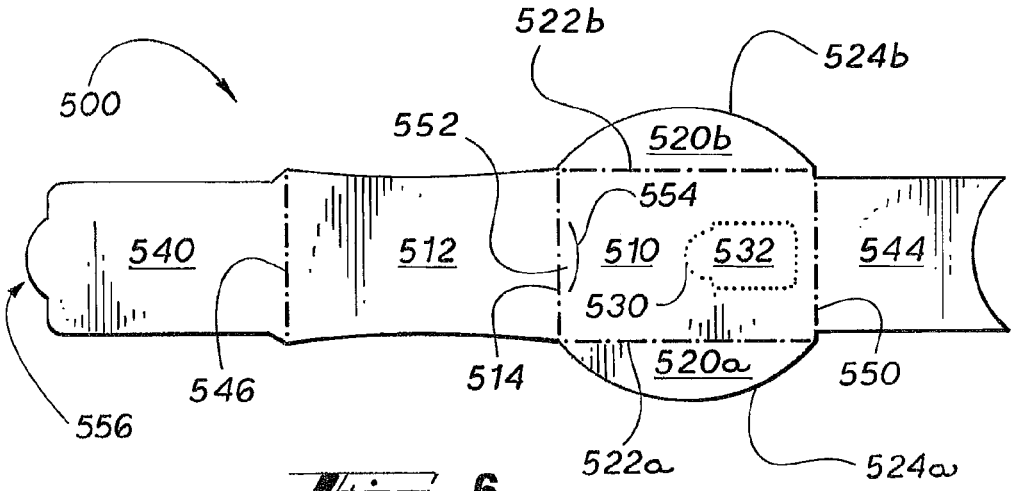
FIG. 6 is a plan view of a blank, according to a third exemplary embodiment of the present disclosure.
Figure 7:
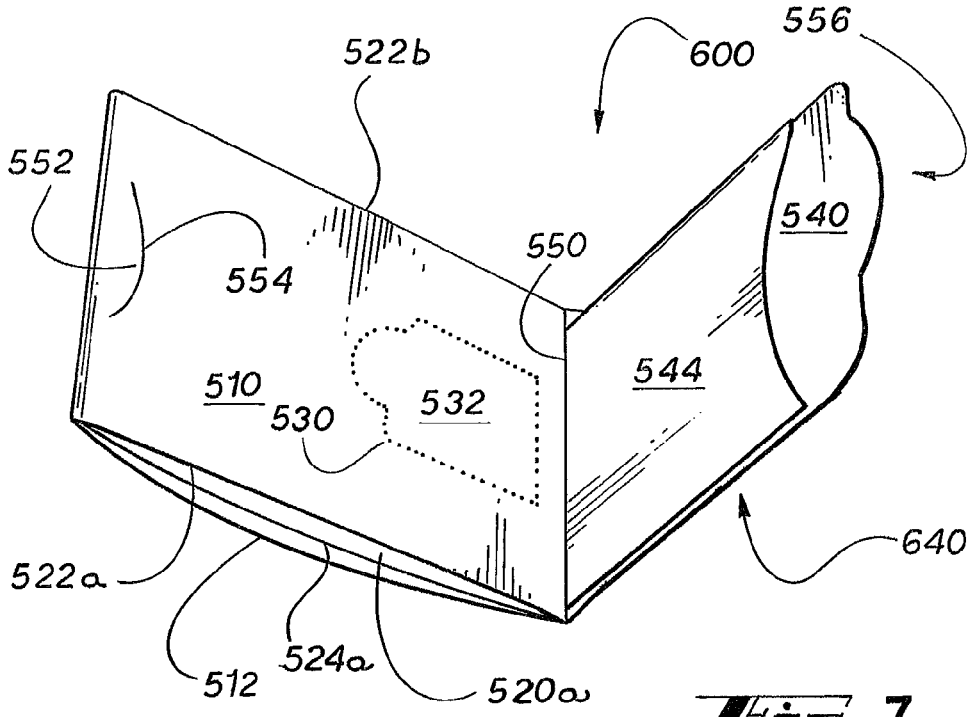
FIGS. 7 and 8 are perspective views of a container formed from the blank of FIG. 6, a cover being illustrated in open and closed conditions.
Figure 8:
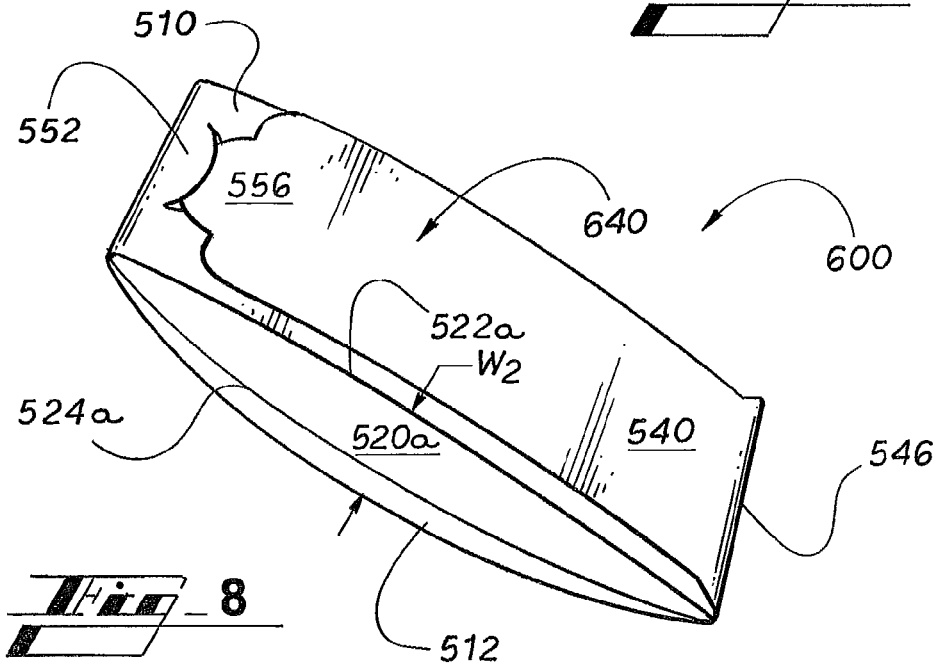

Turning now to FIGS. 6-8, there is illustrated a third embodiment of the present disclosure. Where the elements introduced and described above are present and substantially similar to the elements present is this embodiment, the same element number has been used with the substitution of the prefix "5" for the prefix "1". For example, the top panel 110 shown in FIG. 1 is substantially similar to the top panel 510 shown in FIG. 6. Accordingly, only certain of the elements of the second embodiment are described.

According to an exemplary method of forming the container 600, the side flaps 520*a*, 520*b* are folded toward the inside surface of the top panel 510; the blank 500 is folded along the fold line 514; and the cover flap 544 is secured to the cover panel 540 such that the fold line 546 is proximate the fold line 550.

The top panel 510 and bottom panel 512 can be secured as a tubular structure according to alternative methods. For example, in embodiments of containers where the cover 640 is omitted, the flap 544 is secured to the bottom panel 512.

The container 600 includes a larger detachable tab 532, an alternative cover 640, and an alternative configuration of locking tabs 552, 556. The size of the detachable tab 532 facilitates dispensing loose-fill articles or one or more articles that are packaged in a larger blister. As described above, the cover 640 is formed as the cover flap 544 is secured to the cover panel 540. The locking tabs 552, 556 are configured such that the first locking tab 556 is defined at a distal edge of the cover 640 and the second locking tab 552 is defined in the top panel 510 by a severance line 554. To releasably interlock the locking tabs 552, 556, the top panel 510 can be depressed adjacent the second locking tab 552 such that the first locking tab 556 can be inserted between the top panel 510 and the second locking tab 552.

The present disclosure has been illustrated in relation to a particular embodiment which is intended in all respects to be illustrative rather than restrictive. Those skilled in the art will recognize that the present disclosure is capable of many modifications and variations without departing from the scope of the disclosure. For example, as used herein, directional references such as "top", "base", "bottom", "end", "side", "inner", "outer", "upper", "middle", "lower", "front" and "rear" do not limit the respective walls of the container to such orientation, but merely serve to distinguish these walls from one another. Similarly, dimensional references that are applied to elements or the container such as "extending dimension", "open end dimension", "length", "width", and "height" do not limit the orientation or configuration of the element or the container.

The above-described embodiments are merely exemplary illustrations of implementations set forth for a clear understanding of the principles of the disclosure. Variations, modifications, and combinations may be made to the above-described embodiments without departing from the scope of the claims. All such variations, modifications, and combinations are included herein by the scope of this disclosure and the following claims.

What is claimed is:

1. A container, comprising a first packaging structure and a second packaging structure, the second packaging structure at least partially enclosing the first packaging structure, the second packaging structure comprising:

a tubular structure with at least one open side, the tubular structure comprising: a bottom panel, a top panel, an arrangement of severance line configured to allow access to an interior of the container, and at least one side flap that is hingedly connected to an edge of the tubular structure, the at least one side flap being configured to extend inwardly into at least a portion of the tubular structure to at least partially close the at least one open side, the at least one side flap restricting an access to the first packaging, and the at least one side flap includes an aperture for receiving the blister portion, the first packaging structure comprising a blister that includes a blister portion and a flange portion, wherein:

the flange portion is in contact with an inside surface of the top panel, and the blister portion aligns with the severance lines such that a packaged material inside the blister portion is accessible through the severance lines.

2. The container of claim 1, further comprising a cover.

3. The container of claim 2, wherein the cover includes a first locking structure;

wherein the top panel includes a second locking structure, and wherein the first locking structure releasably engages with the second locking structure to releasably secure the cover to the top panel of the tubular structure.

4. The container of claim 1, wherein the top panel is substantially flat.

5. The container of claim 1, wherein the bottom panel is substantially curved.

6. The container of claim 1, wherein the edge of the tubular structure along which the at least one side flap is hingedly connected comprises a side edge of the top panel.

7. The container of claim 1, wherein a distal edge of the at least one side flap is configured to at least partially contact at least a portion of an inside surface of the bottom panel.

8. The container of claim 1, wherein the distal edge of the at least one side flap is substantially curved.

9. The container of claim 1, wherein an extending dimension (W1) of the at least one side flap is greater than an open end dimension (W2) of the tubular structure.

10. The container of claim 1, wherein the container further includes a cover configured to selectively overlap the arrangement of severance lines.

11. The container of claim 2, wherein the cover comprises:

a cover panel hingedly connected to the bottom panel via a first fold line, a cover flap hingedly connected to the top panel via a second fold line, the cover flap being secured to the cover panel such that the first fold line is proximately the second fold line to form the cover.

12. The container of claim 1, wherein the first packaging structure is configured to obstruct an inward movement of the at least one side flap.

13. A container, comprising:

a first packaging structure;

a second packaging structure at least partially enclosing the first packaging structure, the second packaging structure comprising a tubular structure with at least one open side, wherein the tubular structure comprises a bottom panel, a top panel, and at least one side flap that is hingedly connected to an edge of the tubular structure, the at least one side flap being configured to extend inwardly into at least a portion of the tubular structure to at least partially close the at least one open side; and the at least one side flap restricting an access to the first packaging structure; and a cover comprising:

a cover panel hingedly connected to the bottom panel, a sleeve flap hingedly connected to the cover panel, and an insert flap hingedly connected to the top panel, wherein the cover panel and the sleeve flap form a sleeve into which the insert flap is slideably inserted.

* * * * *